US009413127B2

(12) United States Patent
Holzapfel

(10) Patent No.: US 9,413,127 B2
(45) Date of Patent: Aug. 9, 2016

(54) SELF-LUBRICATING SLIPRING

(71) Applicant: Schleifring und Apparatebau GmbH, Fürstenfeldbruck (DE)

(72) Inventor: Christian Holzapfel, Fürstenfeldbruck (DE)

(73) Assignee: SCHLEIFRING UND APPARATEBAU GMBH, Furstenfeldbruck (DE)

( * ) Notice: Subject to any disclaimer, the term of this patent is extended or adjusted under 35 U.S.C. 154(b) by 0 days.

(21) Appl. No.: 14/743,192

(22) Filed: Jun. 18, 2015

(65) Prior Publication Data

US 2015/0288121 A1 Oct. 8, 2015

Related U.S. Application Data

(63) Continuation of application No. PCT/EP2012/076036, filed on Dec. 18, 2012.

(51) Int. Cl.

| | |
|---|---|
| ***H01R 39/08*** | (2006.01) |
| ***H01R 39/56*** | (2006.01) |
| ***H01R 39/22*** | (2006.01) |
| ***H01R 43/10*** | (2006.01) |
| *H01R 43/12* | (2006.01) |

(52) U.S. Cl.

CPC ..... *H01R 39/56* (2013.01); *H01R 39/08* (2013.01); *H01R 39/22* (2013.01); *H01R 43/10* (2013.01); *H01R 43/12* (2013.01)

(58) Field of Classification Search

CPC ..... H01R 39/56; H01R 39/08; H01R 39/22; H01R 43/10; H01R 43/12

USPC ..... 319/232

See application file for complete search history.

(56) References Cited

U.S. PATENT DOCUMENTS

| | | | | |
|---|---|---|---|---|
| 533,038 | A | 1/1895 | Hirsch | |
| 738,478 | A | 9/1903 | Phillips | |
| 2,555,997 | A * | 6/1951 | Porail | H01R 39/646 310/219 |
| 3,437,592 | A * | 4/1969 | Boes | C10M 7/00 508/108 |
| 4,267,476 | A * | 5/1981 | Lee | H01R 39/22 310/248 |
| 4,277,708 | A * | 7/1981 | McNab | H01R 39/46 310/228 |
| 4,398,113 | A * | 8/1983 | Lewis | H01R 39/18 310/232 |
| 6,502,298 | B1 * | 1/2003 | Witherspoon | H01R 43/10 29/597 |

(Continued)

FOREIGN PATENT DOCUMENTS

| | | |
|---|---|---|
| FR | 2 917 249 | 12/2008 |
| JP | 2001 314066 | 11/2001 |

OTHER PUBLICATIONS

International Search Report and Written Opinion in International Application No. PCT/EP2012/076036 dated Aug. 23, 2013.

(Continued)

*Primary Examiner* — Ross Gushi

(74) *Attorney, Agent, or Firm* — Norton Rose Fulbright US LLP

(57) ABSTRACT

A slip ring has a slip ring track with a contact area, the contact area containing a plurality of pores or cavities. A lubricant is held within these pores and cavities and is enclosed by a top coating. When a slip ring brush is sliding over the slip ring track, it rubs off particles of the top coating, therefore opening some of the pores or cavities which release parts of the lubricant contained therein. This lubricant reduces surface friction of the slip ring brush at the slip ring track and therefore further wear, which results in an extended lifetime.

22 Claims, 3 Drawing Sheets

(56) References Cited

U.S. PATENT DOCUMENTS 6,644,977 B1 11/2003 Dollhofer ..... 439/13
6,753,635 B2 * 6/2004 Kuhlmann-Wilsdorf H01H 1/06 29/596
7,019,431 B1 * 3/2006 Kerlin ..... H01R 39/646 310/232
7,423,359 B2 * 9/2008 Lewis ..... H01R 39/24 310/232
7,960,317 B2 * 6/2011 Ziegert ..... C10M 103/00 310/228
2011/0263468 A1 * 10/2011 Ziegert ..... C10M 103/00 508/154
2014/0179125 A1 * 6/2014 Holzapfel ..... H01R 39/025 439/28
2015/0280534 A1 * 10/2015 Arakawa ..... H02K 9/28 310/227
2015/0288121 A1 * 10/2015 Holzapfel ..... H01R 39/22 439/3

OTHER PUBLICATIONS

International Preliminary Report on Patentability in International Application No. PCT/EP2012/076036 dated Jun. 23, 2015.

* cited by examiner

SELF-LUBRICATING SLIPRING

PRIORITY CLAIM

This application is a continuation of pending International Application No. PCT/EP2012/076036 filed on 18 Dec. 2012, which designates the United States, which is incorporated by reference in its entirety.

BACKGROUND OF THE INVENTION

1. Field of the Invention

The invention relates to slip rings for transferring electrical power and/or signals between a rotating and a stationary part.

2. Description of Relevant Art

Electrical slip rings are used to transfer electrical power and/or signals between a rotating and a stationary part. Such devices are used in different applications, like wind energy plants or computer tomography scanners. There are also several military and aerospace applications. In all applications electrical current may be transferred continuously over a full rotation of the parts.

It is common to all of these applications, that a high lifetime and a low contact resistance as well as a low contact noise are required. Furthermore, in specific applications like a CT scanner, comparatively high speeds caused by a rotation of up to four revolutions per second in a circumference of about 5 meters require specific attention. The same applies for specific environmental requirements like in aerospace applications.

To increase lifetime, reliability, and to improve contact characteristics, it is known to lubricate a slip ring. The European patent publication EP 1 026 794 B1 discloses to lubricate a slip ring by using a lubricant with a selected viscosity. It is further noted therein that a certain amount of lubricant is required to ensure lubrication over a long service time, but application of too much lubricant should be avoided in order to prevent floating of the slip ring brush on the track.

The German Patent publication DE 10 2009 022959 B4 discloses a slip ring for a CT scanner which has a channel around the slip ring track to collect excess lubricant. Furthermore, a felt body is provided, redistributing the collected lubricant on the surface of the slip ring track.

In the European patent application publication EP 1 898 500 A2, a fiber brush slip ring is disclosed, which does not need any lubrication and therefore overcomes the above problems.

SUMMARY OF THE INVENTION

The embodiments are based on the object of providing a slip ring having a reliable long-time lubrication which is sufficient for maintaining reliability of the slip ring and good contact characteristics, like low contact resistance and low noise without causing the slip ring brush to float on the slip ring track.

A preferred embodiment comprises at least a slip ring track, which has a surface defining a contact area for a sliding brush. Either this surface may be a planar surface, or it may have any structure for guiding a brush in contact with that surface. Preferably, such a structure is a V-shaped groove. The slip ring track usually comprises an electrical conductive material like brass or steel. It preferably has a surface coated by a contact area material, which provides good electrical contact properties. Suitable materials may comprise a noble metal, like gold or silver, or any alloy thereof. It is not relevant for the embodiment, whether the contact area is a specific contact area material or if the material of the slip ring track itself provides sufficient contact properties. Therefore, in the following, reference is made only to the contact area. The contact area is porous, therefore providing a plurality of small pores or cavities, which are filled with a lubricant. There may also be different types of lubricant in different cavities. To prevent an immediate release of the lubricant contained in the cavities, the cavities are closed by means of a top coating. This top coating preferably is a contact material as described above. Most preferably, it is the same contact material as the contact area, but it may also be of a different contact material. It is further preferred, if the thickness of the top coating on the pores or cavities is constant, although it may be desirable to have a varying thickness on different cavities. It is preferred if the top coating is applied by an adhesive or cold welding process, for which a tool comprising the top coating material slides over the surface and releases some of its material to form the top coating. It is essential to perform this coating process in such a way that the lubricant is not released from the cavities. For example, applying the top coating material may be done submerged into the lubricant. To simplify and accelerate the coating process, it is preferred if the material of the coating tool has a lower hardness than the contact area, resulting in quicker release of material from the coating tool to the contact area. The coating (and the step of coating) may also be omitted, if the lubricant may be held within the cavities, e.g. by capillary forces or micro capsules.

The process described herein by this example of a slip ring track may also be applied to a slip ring brush. Therefore, a further embodiment is a slipring brush having a surface as described above. For simplicity, herein embodiments are shown related to a slipring module, but it is understood that they may also be applied to a brush.

After the slip ring module or brush has been finished, it may be stored for a longer time, while the lubricant is enclosed and safely stored in the cavities. When the slip ring is used, a brush is sliding on the slip ring track, and therefore it slowly rubs off particles of the surface of the top coating. For this purpose it is preferred, if the slip ring track has a hardness, which is greater than the hardness of the top coating. It is further preferred, if the brush has a hardness, which is greater than the hardness of the top coating. When sufficient material is removed from the top coating, some cavities or pores are opened and release at least parts of their lubricant. This lubricant is distributed over the slip ring track by time and improves the electrical contact and mechanical characteristics, therefore further decreasing wear of the surface. Therefore, after the first or the first few cavities have been opened, the speed of opening further cavities slows down. This leads to a significant delay in opening other cavities, and further leads to an extended lifetime. In general, cavities are only opened when required due to lacking lubricant, which results in a slightly increased wear. To improve this process, it is preferred if the thickness of the top coating is varying. Furthermore, the process of release of lubricant may be controlled by modifying the pores or cavities. For example, the cavities may have a kind of bottleneck, which leads to a delayed release of lubricant. There may also be a variety of cavities with different properties. For example, there may be wide-open cavities for a quick release of lubricant, and there may be bottleneck cavities for a delayed release of lubricant, therefore allowing a further delay of release of the lubricant.

BRIEF DESCRIPTION OF THE DRAWINGS

In the following, the invention will be described by way of example, without limitation of the general inventive concept, on examples of embodiment and with reference to the drawings.

Figure 1:
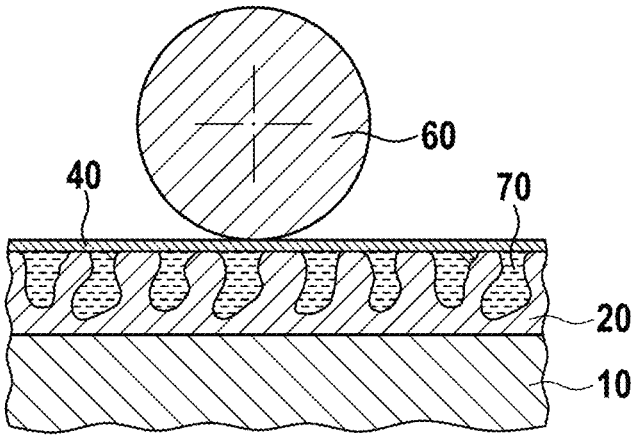
FIG. 1 shows a slip ring track.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

In FIG. 1, a slip ring track in a first embodiment is shown. A slip ring track 10, 11 has a contact area 20, 21 with a plurality of pores or cavities 30, 31. These cavities contain a lubricant 70. Furthermore, they are covered with a top coating 40, 41. A slip ring brush 60 which is a wire brush comprising a wire of conductive material is sliding on top of the top coating and on the contact area, when the top coating has been worn off. It is noted that the relations of sizes are not in scale. In general, the thickness of the contact area 20 is in an order of magnitude of some tenths of micrometers. A preferred range is between 30 and 100 micrometers. In contrast thereto, the diameter of a slip ring brush 60 is in the order of magnitudes of millimeters. A preferred range of diameter is between 0.1 millimeters and 3 millimeters. In all figures, the thickness of the contact area 20, the pores or cavities 30, and the top coating 40 have been enlarged to show more details.

Figure 2:
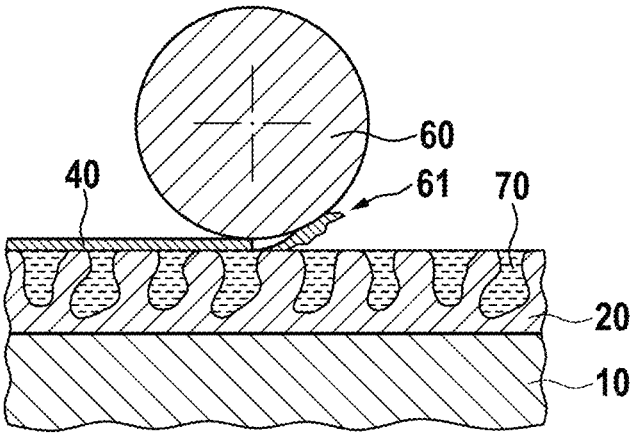
FIG. 2 shows a slip ring during operation.

In FIG. 2, the slip ring is shown during operation. When the slip ring brush 60 is sliding over the surface of the slip ring track, it rubs off at least parts of the top coating 40, resulting in worn material particles 61. It is noted that the preferred direction of movement is along the axis of the slip ring brush, which has a circular cross-section inhere, which is a movement in and/or out of the drawing plane. At the right side of this figure, almost the whole top coating 40 has been removed which may be caused by a longer movement of the brush in this area, while the top coating 40 at the left side is still intact. The pores or cavities 30 at the right side have been opened and therefore gradually release the lubricant contained therein.

Figure 3:
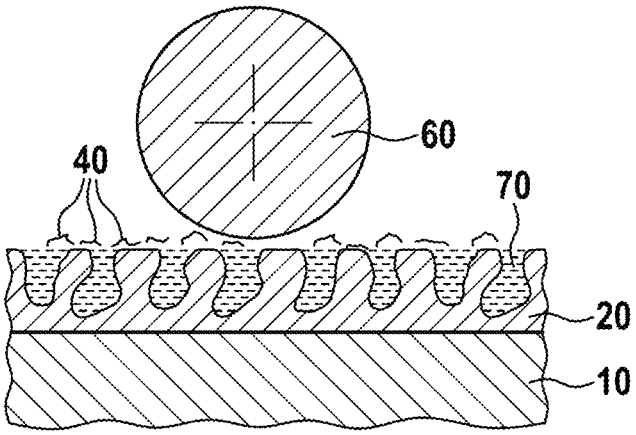
FIG. 3 shows a different stadium of operation.

In FIG. 3, a different stadium of operation is shown. Here, almost all the top coating 40 has been removed by the slip ring brush 60. Therefore, all pores or cavities 30 are open and release lubricant 70, which leads to a significant decrease in wear and in an extended lifetime of the slip ring brush.

The term "hardness" relates to the characteristics of materials in the sense that a harder material sliding on a softer material rubs off the softer material. It is preferred, if the term "hardness" relates to Rockwell hardness, Brinell hardness or Vickers hardness.

In FIGS. 4 to 8, different steps of manufacturing a slip ring track are disclosed. In FIGS. 4A, 5A, 6A, 7A, and 8A, a flat slip ring track is shown, while FIGS. 4B, 5B, 6B, 7B, and 8B show a V-groove-shaped slip ring track. In the following, in general it is not distinguished between these different types of tracks, unless expressly noted.

Figure 4A:
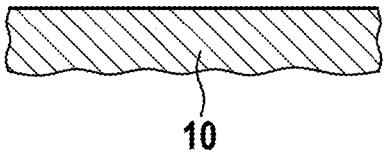
FIGS. 4A to 8B show different steps in manufacturing the slip ring track.
Figure 4B:
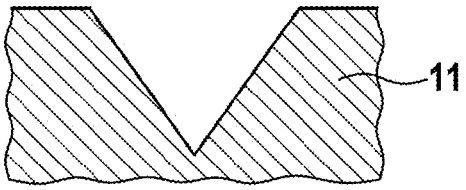

FIGS. 4A and 4B each shows a raw slip ring track 10, 11 that may be of a conductive material like brass.

Figure 5A:
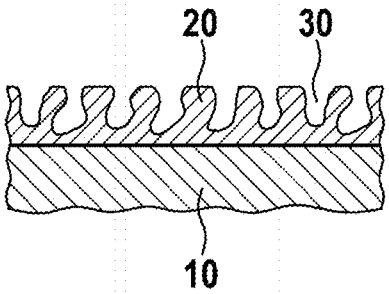
Figure 5B:
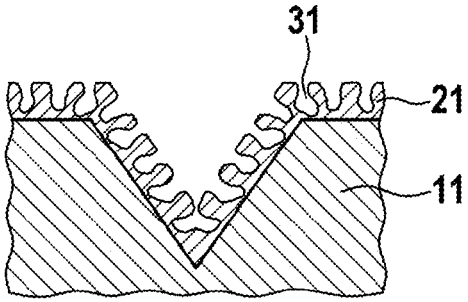

In FIGS. 5A and 5B, each of slip ring tracks 10 and 11, respectively, is coated with a contact area 20, 21. The contact area has a plurality of pores or cavities 30, 31.

Figure 6A:
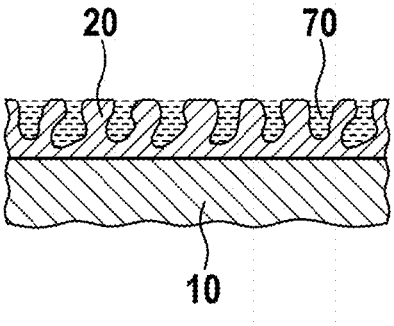
Figure 6B:
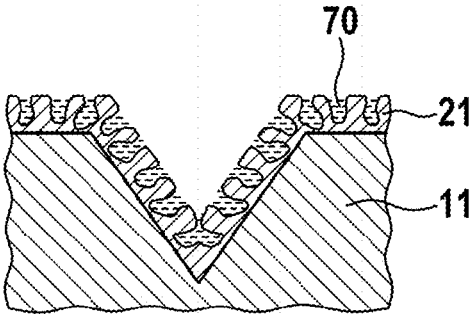

In FIGS. 6A and 6B, the pores or cavities have been filled by a lubricant 70, preferably by immersion into a liquid lubricant.

Figure 7A:
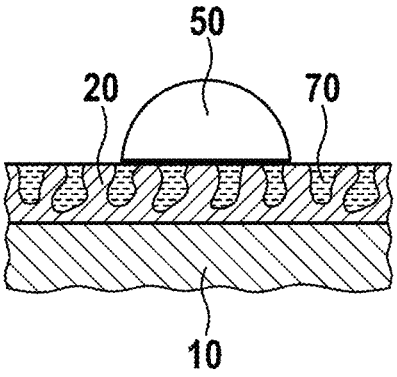
Figure 7B:
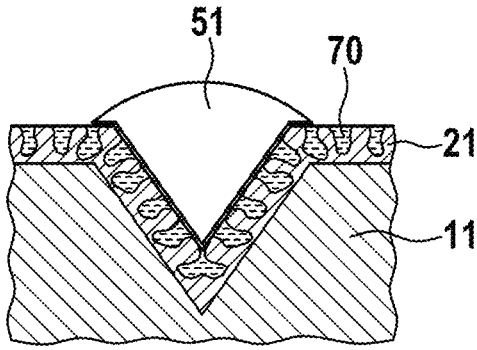

FIGS. 7A and 7B each shows the process of coating the pores or cavities. This is preferably done by using a coating tool 50, 51, which is adapted to the shape of the slip ring track. In FIG. 7A, in the case of a flat slip ring track 10, the coating tool 50 preferably has a flat surface. In the case of a V-groove-shaped slip ring track 11 as shown in FIG. 7B, preferably a V-shaped coating tool is used. The coating tool preferably has at least a surface comprising of the top coating material for top coatings 40, 41, alternatively the tool may have a solid bode of the material. Most preferably, this material has a lower hardness than the hardness of the contact area 20, 21 material.

In another preferred embodiment, the pores or cavities may be closed by pressing a thin film or layer and/or laminating such a film or layer of a contact material on the surface of the pores of cavities. In a further embodiment, the pores or cavities are closed by pressure from a coating tool, the pressure deforming the topmost layer of the surface of the contact area and therefore closing the channels of the pores or cavities.

Figure 8A:
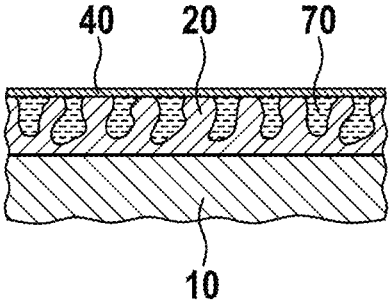
Figure 8B:
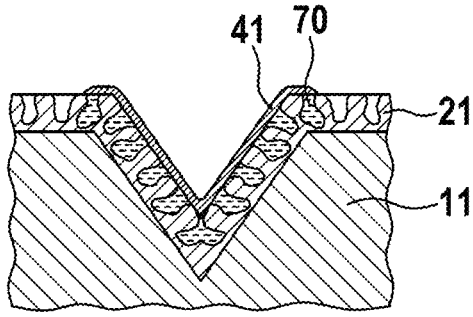

In FIGS. 8A and 8B, the finished slip ring tracks are shown. The top coating 40, 41 on top of the contact area 20, 21 is closing the pores or cavities 30, 31, and therefore enclosing the lubricant 70. In FIG. 8B, there are some exemplary pores or cavities, which are no more filled by the lubricant, as they are not closed by top coating 41.

It will be appreciated to those skilled in the art having the benefit of this disclosure that this invention is believed to provide a slipring track and a slipring. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

10 flat slipring track
11 V-groove slipring track
20, 21 contact area
30, 31 pores or cavities
40, 41 top coating
50, 51 coating tool
60 slipring brush
61 worn material
70 lubricant

The invention claimed is:

1. Slip ring track comprising a contact area with a plurality of pores or cavities, wherein at least some of the pores or cavities are closed by a top coating on the surface of the contact area, and at least some of the closed pores or cavities contain a lubricant.

2. Slip ring track according to claim 1 wherein at least some of the plurality of the pores or cavities each has a bottleneck configured to delay release of the lubricant upon uncovering of the pore or cavity.

3. Slip ring track according to claim 1 wherein at least some of the pores or cavities have different depths below the top coating.

4. Slip ring track according to claim 1 wherein at least some of the pores or cavities contain different types of lubricant.

5. Slip ring track comprising a contact area in which a plurality of pores or cavities is provided, wherein at least some of the pores or cavities contain a lubricant that is held in the pores or cavities by capillary forces.

6. Slip ring track according to claim 5 wherein at least some of pores or cavities each has a bottleneck configured to delay release of the lubricant.

7. Slip ring track according to claim 5 wherein at least some of the pores or cavities have different depths below the top coating.

8. Slip ring track according to claim 5 wherein at least some of the pores or cavities contain different types of lubricant.

9. Slip ring brush comprising a contact area with a plurality of pores or cavities , wherein at least part of the pores or cavities are closed by a top coating on the surface of the contact area, and at least some of the pores or cavities contain a lubricant.

10. Slip ring brush according to claim 9 wherein at least some of the pores or cavities each has a bottleneck configured to delay release of the lubricant upon uncovering of the pore or cavity.

11. Slip ring brush according to claim 9 wherein at least some of the pores or cavities have different depths below the top coating.

12. Slip ring brush according to claim 9 wherein at least some of the pores or cavities contain different types of lubricant.

13. Method for manufacturing a slip ring track, comprising the steps of:

providing a slip ring track having a contact area with a plurality of pores or cavities, disposing a lubricant in at least some of the pores or cavities, covering at least some of the pores or cavities with a top coating to contain the lubricant.

14. Method for manufacturing a slip ring track according to claim 13 wherein at least some of the pores or cavities each has a bottleneck configured to delay release of the lubricant upon uncovering the pore or cavity.

15. Method for manufacturing a slip ring track according to claim 13 wherein at least some of the pores or cavities have different depths below the top coating.

16. Method for manufacturing a slip ring track according to claim 13 wherein at least some of the pores or cavities contain different types of lubricant.

17. Method for manufacturing a slip ring brush, comprising the steps of:

providing a slip ring brush having a contact area with a plurality of pores or cavities, disposing a lubricant in at least some of the pores or cavities, covering at least some of the pores or cavities with a top coating to contain the lubricant.

18. Method for manufacturing a slip ring brush according to claim 17 wherein at least some of the pores or cavities each has a bottleneck configured to delay release of the lubricant upon uncovering the pore or cavity.

19. Method for manufacturing a slip ring brush according to claim 17 wherein at least some of the pores or cavities have different depths below the top coating.

20. Method for manufacturing a slip ring brush according to claim 17 wherein at least some of the pores or cavities contain different types of lubricant.

21. Method of lubricating a slip ring, comprising the steps of:

sliding a slip ring brush on a slip ring track having a contact area with a plurality of pores or cavities covered by a top coating, rubbing off parts of the top coating with the slip ring brush, and opening at least one of the pores or cavities below the top coating to release lubricant from the opened at least one of the pores or cavities.

22. Method of lubricating a slip ring according to claim 21 wherein the slip ring brush is harder than the top coating.

* * * * *